United States Patent [19]

Hill

[11] Patent Number: 4,698,032

[45] Date of Patent: Oct. 6, 1987

[54] CONTROL UNIT FOR OUTBOARD MARINE MOTOR ASSEMBLY

[76] Inventor: David A. Hill, 9547 Old Creek Dr., Fairfax, Va. 22032

[21] Appl. No.: 616,758

[22] Filed: Jun. 4, 1984

[51] Int. Cl.[4] ..... B63H 5/12

[52] U.S. Cl. ..... 440/6; 440/58

[58] Field of Search ..... 440/6, 58, 84–87, 440/68; 114/144 R, 146; 74/422

[56] References Cited

U.S. PATENT DOCUMENTS

| | | | |
|---|---|---|---|
| 1,800,638 | 2/1931 | Kopke et al. | 440/87 X |
| 2,520,652 | 8/1950 | Pfauser et al. | 74/544 |
| 2,595,597 | 5/1952 | Morseth | 15/144 |
| 2,605,950 | 8/1952 | Colvin | 74/422 X |
| 2,641,012 | 6/1953 | Storrs | 287/58 |
| 2,785,584 | 3/1957 | Hambleton | 440/87 X |
| 2,903,903 | 9/1959 | Jaromy | 74/471 |
| 3,174,357 | 3/1965 | Conklin | 74/480 |
| 3,580,212 | 5/1971 | Fortson | 440/6 |
| 3,814,961 | 6/1974 | Nelson et al. | 440/6 X |
| 3,861,348 | 1/1975 | Beierle | 440/6 |
| 4,051,802 | 10/1977 | Russell | 115/17 |

FOREIGN PATENT DOCUMENTS

| | | | |
|---|---|---|---|
| 254620 | 7/1926 | United Kingdom | 440/58 |

*Primary Examiner*—Sherman D. Basinger

*Attorney, Agent, or Firm*—Griffin, Branigan & Butler

[57] ABSTRACT

A control unit 20 for use in combination with an outboard marine motor assembly includes a handle 110 having a plurality of telescoping sections 112A, 112B, and 112C. A coiled electrical conductor 172 extends through each of the telescoping sections 112A, 112B, and 112C and connects with electrical switch provided on a handle grip 114 of the furtherest extendable of the telescoping handle sections 112C. In one embodiment the electrical switch comprises a first switch 166 for selectively activating a motor 24 which drives a propeller 26 and a second switch 168 for selecting a desired speed for the motor 24. The handle 110 is connected to a second gearing 84. The second gearing 84 meshes with a first gearing 82 whereby the angular displacement of the handle 110 and the second gearing 84 connected thereto results in a greater angular displacement of both the first gearing 82 and a rotational shaft 28 about which the first gearing 82 is concentrically mounted. Angular displacement of the rotational shaft 28 changes the orientation of the motor 24 and propeller 26 connected to the lower end of the shaft 28, and thus alters the coarse of the craft 22 on which the outboard marine motor assembly is mounted.

22 Claims, 6 Drawing Figures

CONTROL UNIT FOR OUTBOARD MARINE MOTOR ASSEMBLY

BACKGROUND OF THE INVENTION

This invention relates to control units and associated extension handles, and particularly to control units for outboard marine trolling motors.

Many outboard marine trolling motors have a propeller and an associated power unit housing connected to the lower end of a shaft. At an upper end of the shaft is a control unit and a handle. A clamp, which rides on the shaft and is selectively tightened at intermediate points thereon, secures the outboard motor asembly to the side of a small marine craft. When the outboard motor assembly is secured by the clamp onto the marine craft, the craft operator uses switches on the control unit to turn on and off the submerged power unit. The craft operator steers the for the power unit. The craft operator steers the craft by moving the handle attached to the control unit, whereby the handle movement causes the shaft and power unit to rotate about the axis of the shaft, thus changing the orientation of the propeller and the course of the craft.

Outboard marine motors of the type described above are used on marine craft employed for numerous purposes, especially for fishing purposes. Operators of marine crafts, such as fisherman, prefer not to be confined to the portion of the craft where the control unit is located, but for convenience and practicality on occasion tend to situate themselves out of reach of the conventional control unit and steering handle. To accommodate this practical tendency, some prior art control units have been connected via cable to remotely positionable foot control peddles. The craft operator positions the foot control peddles as desired on the interior floor of the craft and uses the peddles for steerage purposes. Foot control peddles cannot be used, of course, in crafts which do not have an essentially flat interior floor surface. Moreover, few fishermen are fond of the foot control peddle concept.

Some prior art control units have a telescoping handle for permitting the craft operator to sit further away from the control unit and yet steer the craft with the handle. However, the operator must still reach or even go back to the control unit to change the speed of the power unit, thereby interrupting his primary activity, such as fishing. Moreover, the operator must move the distal end of the telescoped handle, when extended, through a significant arcuate path away form the operator's body. In this respect, to effect a comparable angular displacement of the propeller axis is a greater arcuate path is traversed by the distal end of an extended handle than a shorter handle. To steer the craft, the operator must maneuver the extended handle through the lengthy arcuate path, possibly even having to change his own position in doing so. If the operator stops the craft after having made a sharp turn, the distal end of the extended handle may be oriented in a rest position essentially perpendicularly to the major axis of the craft and possibly out over the water. When the operator desires to start up the craft again, the operator must reach a significant distance to grasp the handle.

In view of the foregoing, it is an object of this invention to provide a handle for an outboard marine motor which is conveniently usable at a remote location in the marine craft.

An advantage of the present invention is the provision of a telescoping handle which is easily usable by a marine craft operator.

Another advantage of the present invention is the provision of a telescoping handle for an outboard marine motor whereby a marine craft operator can easily change the speed of a power unit associated with the motor.

Still another advantage of the present invention is the provision of a telescoping handle whereby small angular displacement of the handle by an operator rotates the power unit and propeller of a trolling motor through a much greater angular displacement including 360°.

SUMMARY

A control unit for use in combination with an outboard marine motor assembly includes handle means having a plurality of telescoping sections. Coiled electrical conductor means extends through each of the telescoping sections and connects with electrical switch means provided on a handle grip means of the furtherest extendable of the telescoping handle sections. In one embodiment the electrical switch means comprises a first switch for selectively activating a motor which drives a propeller and a second switch for selecting a desired speed for the motor. The handle means is connected to second gearing means. The second gearing means meshes with first gearing means whereby the angular displacement of the handle means and the second gearing means connected thereto results in a greater angular displacement of both the first gearing means and a rotational shaft about which the first gearing means is concentrically mounted. Angular displacement of the rotational shaft changes the orientation of the motor and propeller connected to the lower end of the shaft, and thus alters the coarse of the craft on which the outboard marine motor assembly is mounted.

BRIEF DESCRIPTION OF THE DRAWINGS

The foregoing and other objects, features and advantages of the invention will be apparent from the following more particular description of preferred embodiment as illustrated in the accompanying drawings in which reference characters refer to the same parts throughout the various views. The drawings are not necessarily to scale, emphasis instead being placed upon illustrating the principles of the invention.

DETAILED DESCRIPTION OF THE DRAWINGS

Figure 1:
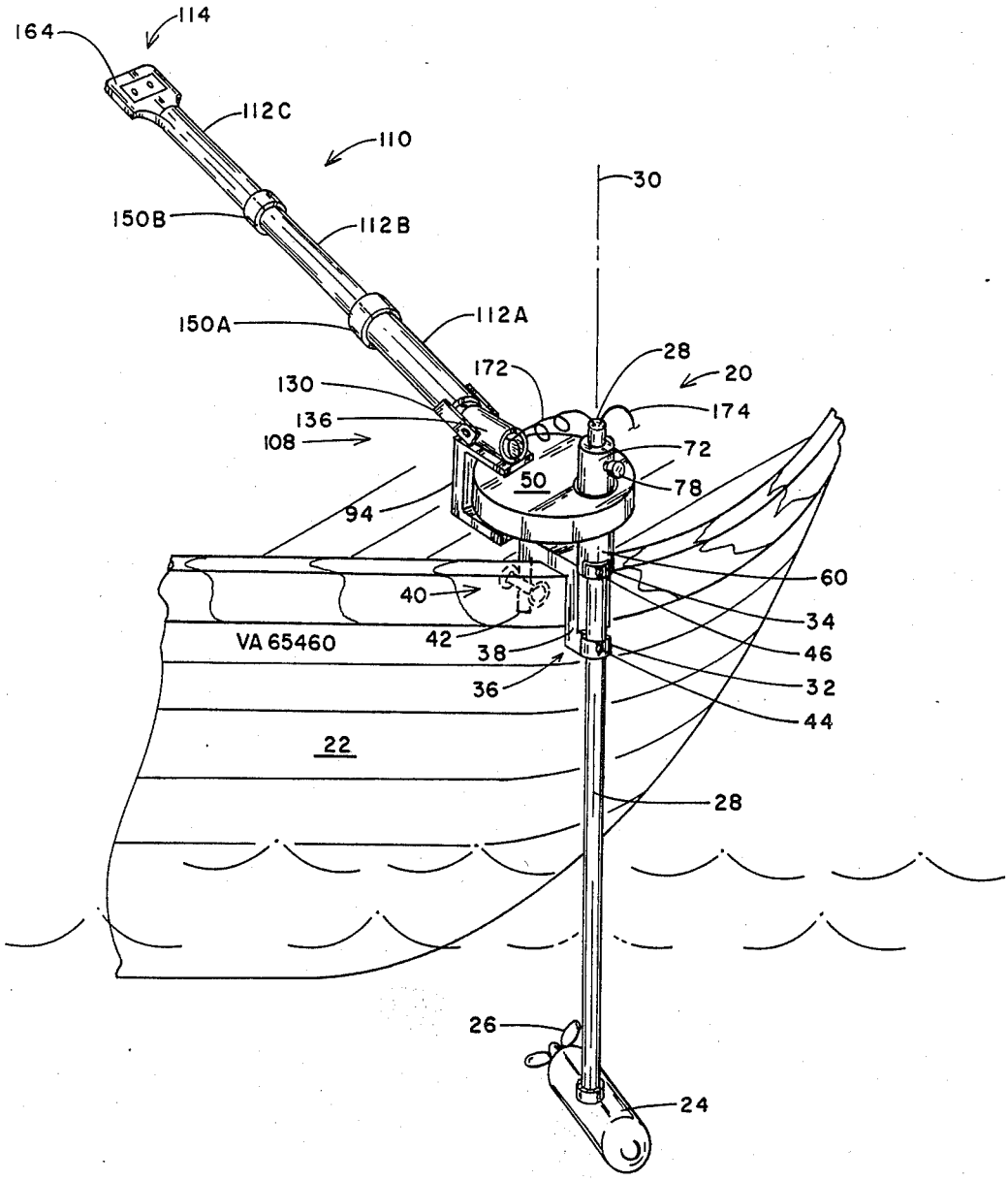
FIG. 1 is a perspective view of a control unit of an outboard marine trolling motor assembly according to an embodiment of the invention as installed on marine craft.

FIG. 1 shows a control unit 20 for an outboard marine trolling motor mounted on marine craft 22, such as a fishing boat. The trolling motor comprises a conventional power unit 24 and associated propulsion means, such a propeller 26, which depend from a shaft 28 for submersion below water level. Shaft 28 is a rotatable shaft, the rotation of which causes the power unit 24 and propeller 26 to rotate about the longitudinal axis 30 of the shaft 28 and thus alter the course of direction of the craft 22.

The trolling motor shaft 28 extends through lower and upper rings 32 and 34, respectively, in a conventional clamp frame member 36. The clamp frame member 36 forms an inverted channel to accommodate the side edge of the craft 22. The rings 32 and 34 are integral with an essentially vertical leg 38 of clamp member 36 which extends on the outer side of the craft. The shaft 28 extends through the rings 32 and 34 in a manner whereby the shaft 28 is rotatable with respect to the rings 32 and 34. A vise-like clamp 40 extends through a leg 42 of the clamp member 36. The essentially vertical leg 42 extends on the inner side of the craft and has the vise-like threaded clamp 40 extending perpendicularly thereto to fasten the clamp frame member 36, and hence the trolling motor assembly, to the craft 22. The rings 32 and 34 carry respective fastener members 44 and 46 thereon. Each fastener member has a threaded shaft which extends radially through the rings to bear against shaft 28 and thereby lock shaft 28 in place when desired.

Figure 4:
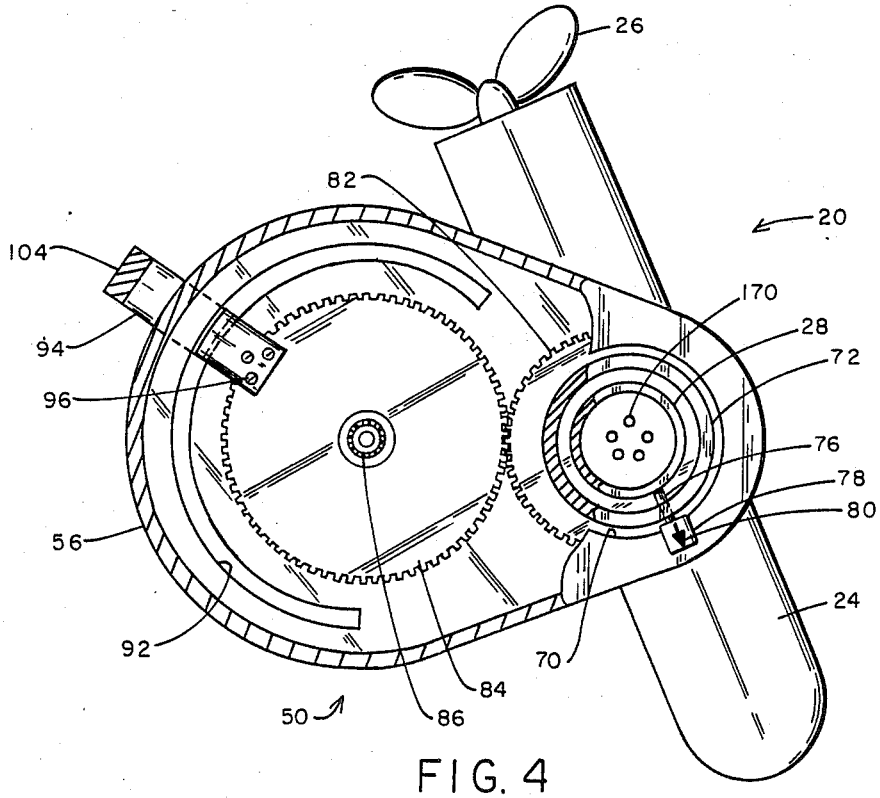

The control unit 20 is mounted towards the upper end of the shaft 28. As seen from above in Fig. 4, the control unit 20 comprises a housing 50 having irregular oval shape. As seen from the side in FIG. 2, the housing 50 has rectangular cross-section. Housing 50 comprises a bottom plate 52; a top plate 54; and, a sidewall 56.

Bottom plate 52 of housing 50 has a circular aperture 58 therein which accommodates the shaft 28. A cylindrical member 60 having an inner diameter substantially equal to the diameter of the circular aperture 58 is integrally formed on or welded to the underside of the bottom plate 52. A side of the cylindrical member near its bottom has a rectangular notch 62 formed therein to accommodate the upper clamp ring 34. Cylindrical member 60, and the housing 50 integral therewith, rests upon and is supported by the clamp frame member 36.

Top plate 54 has an aperture 70 therein to accommodate a sleeve 72 which is coaxial with shaft 28. Aperture 70 has a greater diameter than the aperture 58 formed on the bottom plate 52. An upper portion of the shaft 28 extends above the sleeve 72. Sleeve 72 has a slightly greater interior diameter than the outer diameter of the shaft 28. The bottom of the cylindrical sleeve 72 rests on a bearing such as a nylon or neophrene washer 74.

Sleeve 72 has a threaded radial aperture 76 therein which receives a threaded shaft of lock member 78. When the shaft head of lock member 78 bears tightly against shaft 28, sleeve 72 is locked to shaft 28 so that the shaft and sleeve rotate together. A knob of the lock member 78 has direction indicator means, such as arrow 80, marked thereon.

A first gear means such as gear 82 is concentrically mounted on sleeve 72 whereby rotation of gear 82 causes rotation of the sleeve 72. The peripheral teeth of gear 82 engage a second gear means 84 which lies substantially in the same plane as the first gear 82.

Second gear 84 has a considerably larger diameter than the diameter of the gear 82, and hence the gear ratio of gear 84 to gear 82 is greater than 1.0 and preferably in the range from about 1.5 to 2.5. The rotation of gear 84 is facilitated by a centrally mounted ball bearing 86 which is mounted on a vertical axle member 88. Axle member 88 is secured to the bottom plate 52 of the housing 50 by fastening means 90. The gear 84 rides on a nylon washer 91 interposed between gear 84 and the bottom plate 52.

The bottom plate 52 of housing 50 has an arcuate slot 92 formed near the large end of housing 50. An arm member 94 extends through the slot 92 and is secured by three fasteners 96 counter sunk to a point near the circumference of the gear 84. In this respect, arm member 94 has a first segment 98 which lies in a plane parallel to the plane of the gear 84 and which is attached to gear 84 by fasteners 96. At the unattached end of segment 98 the arm member is bent perpendicularly downwardly forming a second segment 100 which descends through slot 92. Slightly below the plane of the outer surface of the bottom plate 52 the arm 94 is bent or orthogonally radially outward away from the center of gear 84 forming third segment 102. Segment 102 travels in an essentially radial direction from the center of gear 84 sufficiently to clear the side wall 56 of housing 50. After clearing sidewall 56, arm 94 is bent at its furtherest radial extent perpendicularly upwardly to form a fourth segment 104. Segment 104 extends upwardly just past the plane of the upper surface of top plate 54 of housing 50. After clearing top plate 54, the arm 94 is bent orthogonally and radially back inwardly towards the center of second gear 84 to form a fifth segment 106. Segment 106 lies in a plane parallel to but above both segment 102 and the plane of gear 84. Each of the segments 98, 100, 102, 104, and 106 are essentially rectangular cross-section.

Figure 2:
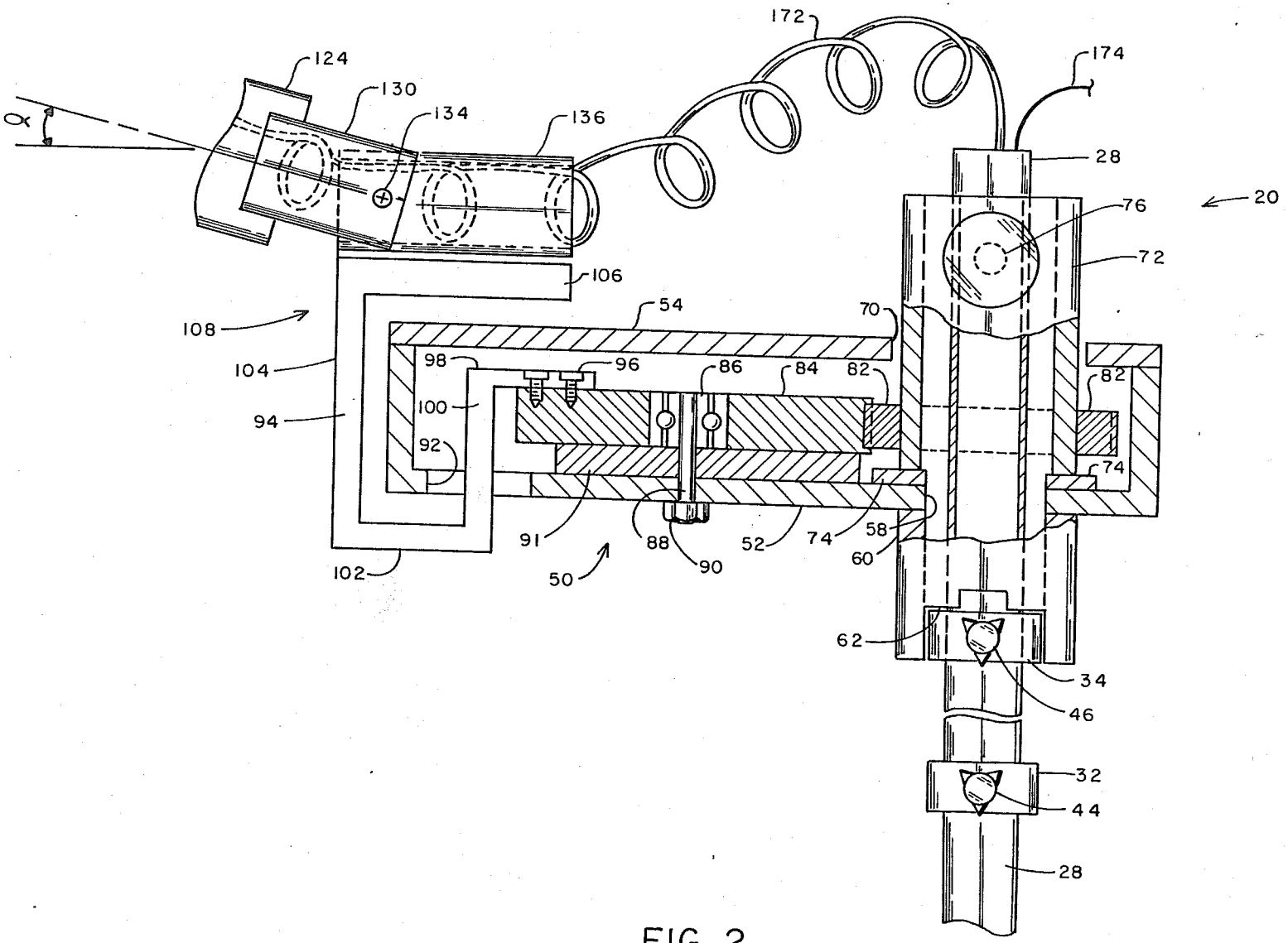
FIG. 2 is a partial side view of the embodiment of FIG. 1 partially shown in cross section.
Figure 2A:
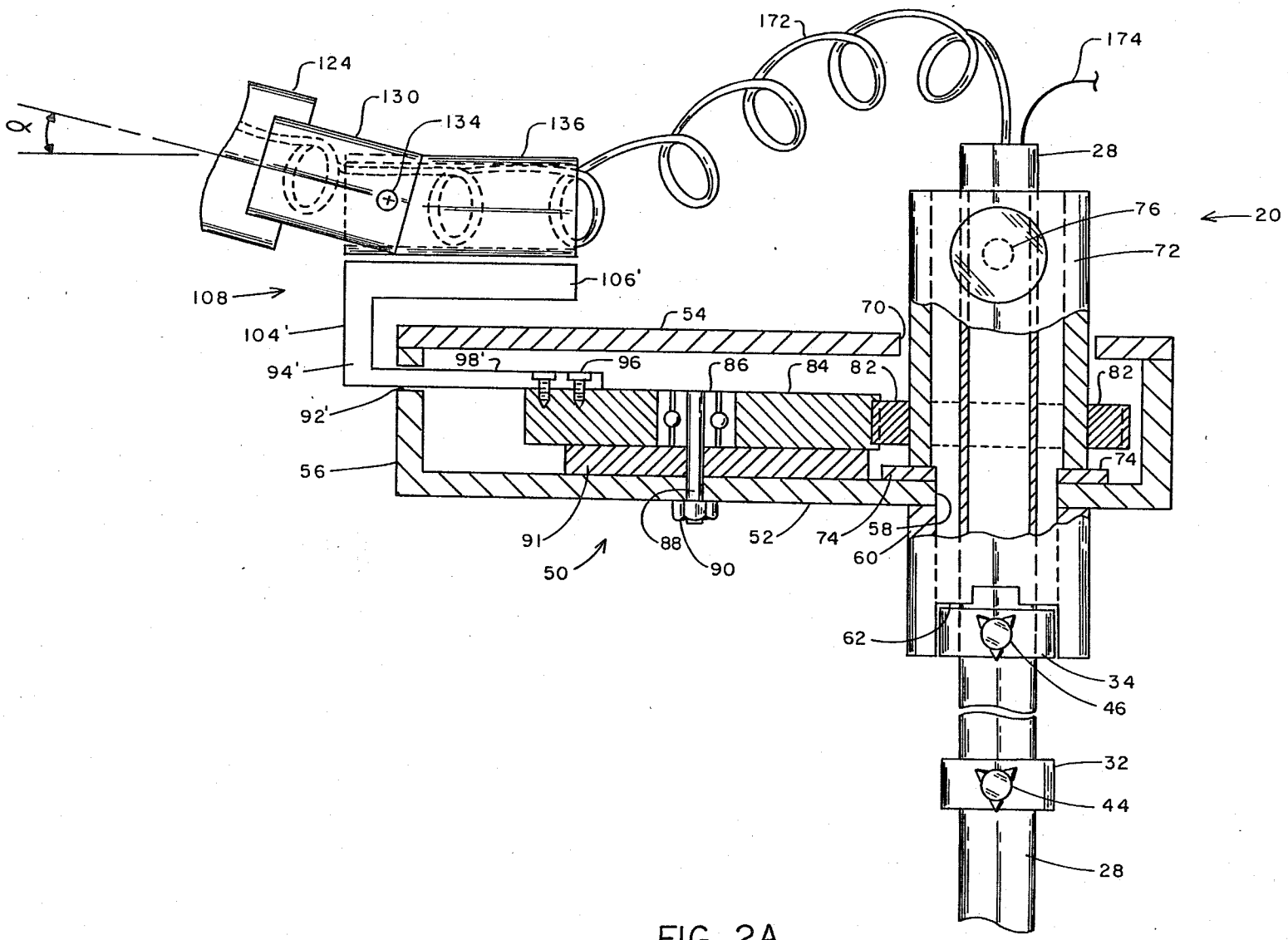
FIG. 2A is a partial side view of another embodiment of the invention partially shown in cross section.

The embodiment of FIG. 2A resembles the embodiment of FIG. 2 but has slot 92' formed in sidewall 56 rather than in bottom plate 52. Arm 94' of the embodiment of FIG. 2 comprises segments 98', 104', and 106'. It should also be understood that in an alternate embodiment a slot through which the arm protrudes is formed in the top plate 54 of the housing 50.

The arm 94 comprises connector means 108 which is used to connect handle means 110 to the housing 50 of the control unit 20. Handle means 110 comprises a plurality of telescoping sections. In the embodiment of FIG. 1, three such telescoping sections, namely sections 112A, 112B, and 112C are shown. The distal end of the potentially most remote telescoping section 112C has handle grip means 114 formed thereon.

Figure 3:
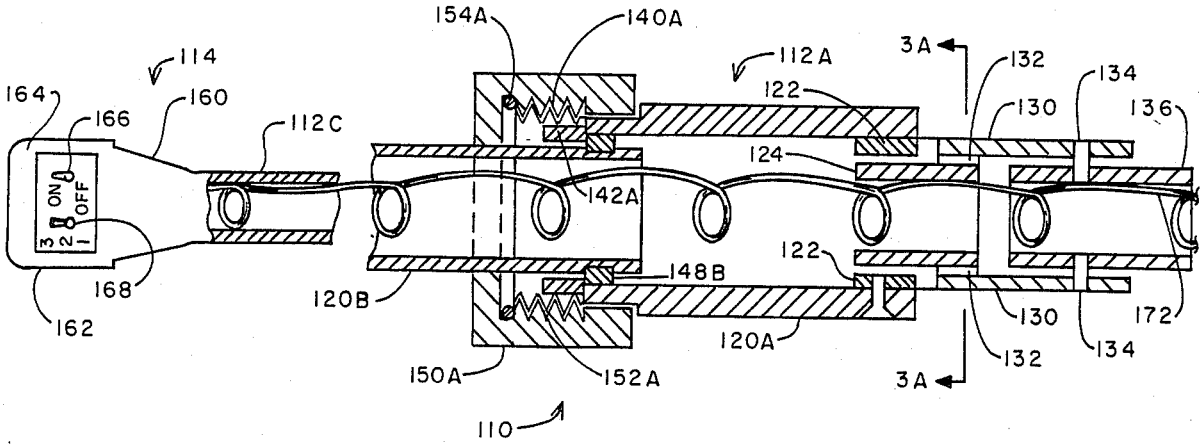
FIG. 3 is a partial cross-sectional view of handle means of the control unit of the embodiment of FIG. 1.
Figure 3A:
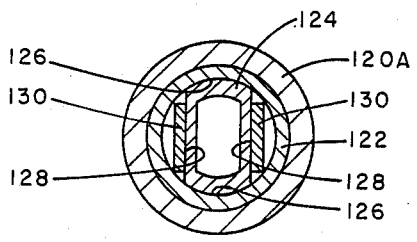
FIG. 3A is a sectional view of the embodiment of FIG. 3 taken along the lines 3A—3A; and, FIG. 4 is a partial top view of the embodiment of FIG. 1 partially shown in cross section.

As shown in FIG. 3, the telescoping section 112A is the section of largest diameter and includes a hollow cylindrical tube 120 formed from a durable plastic or the like. At its end nearest the housing 50 the cylinder 120 has a metal ring secured therein. A hollow metallic member 124 extends along the major axis of the cylinder 120A and is partially inserted in the ring 122 to which it is welded or otherwise secured. As seen in FIG. 3A, in cross-section the member 124 has opposing arcuate surfaces 126 which have an outer diameter just slightly less than the interior diameter of ring 122, and two opposing side surfaces 128 which are flat chords of what would otherwise be a circle formed by the continuation of the arcuate surfaces 126. As seen in FIG. 3, a portion of member 124 protrudes from the cylinder 120A and ring 122.

The portion of the member 124 which protrudes from the ring 122 has first ends of two rectangular bracket members 130 welded, as shown at 132, to its chord-like sides 128. The second ends of the rectangular brackets 130 are pivotally attached at pivot points 134 to chord-like sides of a member 136. Member 136 resembles member 124 inasmuch as member 136 has opposing arcuate surfaces and opposing chord-like surfaces and has an internal cavity formed therein. The underside of member 136 is welded to the upper surface of segment 106 of the arm 94. Thus, member 124; rectangular brackets 130; member 136; and arm 94 comprise the connector means 108 which connects the handle means 110 to housing 50.

The far end of cylinder 120A has an externally threaded region 140A. The interior of the far end of cylinder 120A has a ring-like score on an interior surface thereof at a point just recessed from the end of the cylinder 120A. The score has fitted therein alignment means, such as an annular piece of nylon 142A.

The second telescoping section 112B has a hollow cylindrical tube 120B having an outer diameter less than the inner diameter of cylinder 120A. At its near end to the housing 50 the outer surface of cylinder 120B has a ring-like score thereon to accommodate alignment means, such as an annular piece of nylon 148B. When telescope section 112B is fully extended with respect to telescope section 112A, the pieces 142A and 148B of nylon abutt one another as shown in FIG. 3 to facilitate alignment of the major axes of the telescoping sections 112A and 112B and to thereby prevent the longitudinal drooping of the cylinders 120B and 120A with respect to one another.

A locking cap 150A fits over the far end of cylinder 120A. The internal diameter of locking cap 150A has a threaded region 152A for threaded engagement with threaded region 140A of the cylinder 120A. Locking cap 150A also has an aperture therein to accommodate cylinder 120B of the second telescoping section 112B. An O-ring 154A fits between the cylinder 120A and its locking cap 150A.

The far end of the telescoping section 112B and the near end of telescoping section 112C structurally coact in analogous manner to the far end of telescoping section 112A and the near end of telescoping section 112B as just described. In this respect, the alphabetical suffixes used in conjunction with the reference numerals herein designate appropriate telescoping sections. For example, elements indicated by reference numerals having a "A" suffix refer to the first telescoping section 112A; elements indicated by references numerals having a "B" suffix refer to the second telescoping section 112B, and so forth. It is thus understood that the second telescoping section 112B has some analogous elements to that of telescoping section 112A, such as its own locking cap 150B, for example.

The far end of telescoping section 112C has handle gripping means 114 formed thereon. The gripping means 114 has a quasi-conical hollow neck section 160. A semi-cylindrical head 162 forms the termination of the handle grip means 114. The head 162 has a chord-like planar surface 164 formed thereon. Control switches are mounted on the planar face 164. As shown in FIG. 3, a first switch 166 functions as an on/off switch and a second switch 168, being a three-way position switch, functions as a speed control.

Electrical conductor means extends from terminals of the power unit 124 to the handle gripper means 114. In this regard, a plurality of wires extend from the power unit 124 through shaft 28. Near the top of the shaft 28 appropriate ones of the wires 170 are formed into a helical, compressible, coil-like chord much like a telephone chord. The chord travels through the inner diameter of member 136; through the inner diameter of member 124; and, through the interiors of the cylinders 120A, 120B, and 120C. In the head 162 of the handle gripper means 114 the wires are attached to appropriate terminals of the switches 166 and 168. A similar chord 174 leads from appropriate ones of the wires 170 to a battery (not illustrated) in the craft 22.

In operation, the clamp frame 36 is used to mount the trolling motor to the side of a craft 22 in the position desired. The vise clamp 40 is used to tighten the clamp member so the trolling motor is secured in place. The operator appropriately connects the chord 174 to the battery in the craft 22. The craft operator can then extend the telescoping handle means 110 to the desired degree of extension to accommodate the operator's remote activities in the boat. In this respect, to extend each telescoping section the operator merely loosens the appropriate cap 150 whereby the appropriate cylindrical tube 120 slides along its longitudinal axis to a desired length and the cap 150 is again tightened. Using the extended handle grip means 114 the operator can steer the craft 22; turn on or turn off the motor 24 using switch 166; and, change the speed of the motor (and thus the craft 22) by selecting the desired speed using switch 168.

As the craft operator moves the handle grip means 114 through a degree an angular displacement, the rotational motion of the handle means 110 is transmitted to each of the telescoping sections 112C, 112B, and 112A, and through the connector means 108 including arm 94. The connection of arm 92 to gear 84 causes gear 82 to rotate through the essentially same degree of angular rotation as the handle grip means 114. Gear 82 meshed with gear 84 rotates through a greater degree of angular displacement since the gear ratio of gear 82 to gear 81 is greater than 1.0. The shaft 28 then rotates through the same degree of angular displacement as gear 82 since shaft 28 is locked to gear 82 and sleeve 72 by the locking means 78. As shaft 28 turns, so do (1) the locking means 78 and the direction indicator 80 thereon (which points in the direction of the course of the craft 22) and (2) the power unit 24 and propeller 26.

As described above, by moving the handle grip means 114 through a relatively small angularly displacement a significantly greater rotation of shaft 28 results. With an appropriate gear ratio the operator can move the handle grip means 114 through about a 90° angular displacement with the result that the shaft 28 with power unit 24 and propeller 26 thereon rotate 360 degrees. Accordingly, the operator need never rotate the handle grip means 114 so far away as to be out of his reach or significantly beyond the interior of the craft 22. Furthermore, the switches 166 and 168 are as close to the operator as the handle grip means 114, so that the operator need not reach all the way back to the neighborhood of the housing 50 in order to actuate or change the speed of the motor 24. Moreover, due to the pivotal motion of rectangular brackets 130 with respect to member 136, the longitudinal axis of the handle means 110 is selectively oriented through a range of acute angles alpha with respect to the plane of gear 84.

While the invention has been particularly shown and described with reference to the preferred embodiments thereof, it will be understood by those skilled in the art that various alterations in form and detail may be made therein without departing from the spirit and scope of the invention. For example, improved clamp frame member such as a tiltable clamp frame member is employed in alternate embodiments.

The embodiments of the invention in which an exclusive property or privilege is claimed are defined as follows:

1. A control unit for use in combination with an outboard marine motor assembly, said outboard marine motor assembly having propulsion means and a power unit for driving said propulsion means, said power unit being connected to a lower end of rotatable shaft means, said rotatable shaft means being securable at an intermediate point thereof to a marine craft by clamping means, said control unit comprising:

first gearing means mounted concentrically about said rotatable shaft proximate the upper end of said shaft;

second gearing means adapted to engage said first gearing means, said second gearing means being configured whereby an angular displacement of said second gearing means results in a greater angular displacement of said first gearing means and said shaft;

handle means, said handle means comprising a plurality of telescoping sections, each of said telescoping sections being essentially hollow for selectively accommodating other of said telescoping sections and electrical conductor means, said handle means further comprising handle grip means at a distal end of the furtherest extendable of said telescoping sections, said handle grip means having electrical switch means thereon, said electrical switch means being connected to said electrical conductor means; and, means for connecting said handle means to said second gearing means, said means for connecting said handle means to said second gearing means including means for selectively orienting the axis of said handle means at acute angles with respect to a plane in which said second gearing means lies, and wherein said means for connecting said handle means to said second gearing means has a hollow internal passageway through which said electrical conductor means extends.

2. The control unit of claim 1, further comprising housing means for at least partially enclosing said first gearing means and said second gearing means, said housing means having a arcuate slot therein adapted to accommodate said means for connecting said handle means to said second gearing means and to permit the angular displacement of said second gearing means in response to the displacement of said handle means.

3. The control unit of claim 1, wherein said second gearing means comprises an essentially circular gear, and wherein said handle means is connected to said second gearing means whereby the axis of said handle means is colinear with a radius of the circle of said second gearing means.

4. A control unit for use in combination with an outboard marine motor assembly, said outboard marine motor assembly having propulsion means and a power unit for driving said propulsion means, said power unit being connected to a lower end of rotatable shaft means, said rotatable shaft means being securable at an intermediate point thereof to a marine craft by fastening means, said control unit comprising:

first gearing means;

means for permitting said first gearing means to be rotatable with said rotatable shaft;

second gearing means engageable with said first gearing means, said second gearing means being configured whereby when said gears are engaged an angular displacement of said second gearing means results in a greater angular displacement of said first gearing means and said shaft;

means for permitting said rotatable shaft to be selectively translatable in the direction of its longitudinal axis with respect to at least one of said gearing means;

handle means graspable by an operator; and, means for connecting said handle means to said second gearing means in a manner to permit a longitudinal axis of said handle means to be selectively oriented through a range of angles with respect to said second gearing means.

5. The control unit of claim 4, wherein said handle means comprises handle grip means at a distal end thereof, said handle grip means having electrical switch means thereon, said electrical switch means being connected by electrical conductor means to said power unit.

6. The control unit of claim 4, further comprising means for permitting said first gearing means to be selectively rotatable with said rotatable shaft.

7. The control unit of claim 6, wherein said means for permitting said first gearing means to be selectively rotatable with said rotatable shaft comprises:

a rotatable sleeve having an aperture therethrough for receiving said rotatable shaft, said rotatable sleeve having said first gear means mounted thereon; and, means for selectively locking said rotatable sleeve onto said rotatable shaft.

8. The control unit of claim 4, wherein said rotatable shaft is translatable in the direction of its longitudinal axis with respect to said first gearing means.

9. The control unit of claim 4, wherein said handle means has electrical switch means thereon, and wherein said control unit further comprises:

electrical conductor means connected to said power unit, said electrical conductor means having at least a first conductor portion which extends through a hollow internal portion of said rotatable shaft and a second conductor portion, said second conductor portion comprising a helical coil-like chord for connecting said first conductor portion to said electrical switch means on said handle means.

10. The control unit of claim 4, wherein said handle means comprises a plurality of telescoping sections, each of said telescoping sections being essentially hollow for selectively accommodating other of said telescoping sections, said handle means further comprising handle grip means at a distal end of the furtherest extendable of said telescoping sections.

11. The control unit of claim 10, wherein said handle grip means has electrical switch means thereon, said electrical switch means being connected by said electrical conductor means to said power unit.

12. The control unit of claim 4, wherein said handle means has electrical switch means thereon, wherein electrical conductor means connects said power unit and said electrical switch means, and wherein said means for connecting said handle means to said second gearing means has a hollow internal passageway through which said electrical conductor means extends.

13. The control unit of claim 4, wherein said means for permitting said rotatable shaft to be selectively translatable comprises:

a rotatable sleeve having an aperture therethrough for receiving said rotatable shaft, said rotatable sleeve having said first gear means mounted thereon; and, means for selectively locking said rotatable sleeve onto said rotatable shaft.

14. A control unit for use in combination with an outboard marine motor assembly, said outboard marine motor assembly having propulsion means and a power unit for driving said propulsion means, said power unit being connected to a lower end of rotatatable shaft means, said rotatable shaft means being securable at an intermediate point thereof to a marine craft by fastening means, said control unit comprising:

first gearing means mounted on said shaft in a manner to be rotatable with said rotatable shaft;

second gearing means engageable with said first gearing means, said second gearing means being configured whereby an angular displacement of said second gearing means results in an greater angular displacement of said first gearing means and said shaft;

handle means graspable by an operator;

means for connecting said handle means to said second gearing means in a manner to permit a longitudinal axis of said handle means to be selectively oriented through a range of angles with respect to said second gearing means; and, means for permitting said first gearing means to be selectively disengageable and re-engageable with said second gearing means whereby an angular relationship between said major axis of said handle means and said direction of propulsion is changeable.

15. The control unit of claim 14, wherein said means for permitting said first gearing means to be selectively disengageable and re-engageable with said second gearing means comprises:

a rotatable sleeve having an aperture therethrough for receiving said rotatable shaft, said rotatable sleeve having said first gear means mounted thereon; and, means for selectively locking said rotatable sleeve onto said rotatable shaft.

16. The control unit of claim 14, wherein said handle means comprises a plurality of telescoping sections, each of said telescoping sections being essentially hollow for selectively accommodating other of said telescoping sections, said handle means further comprising handle grip means at a distal end of the furtherest extendable of said telescoping sections.

17. The control unit of claim 16, wherein said handle grip means has electrical switch means thereon, said electrical switch means being connected by said electrical conductor means to said power unit.

18. The control unit of claim 14, wherein said handle means comprises:

at least two telescoping sections, said telescoping sections comprising an essentially hollow cylinder, a first of said telescoping sections having an inner diameter which is greater than the outer diameter of a second of said telescoping sections whereby said first telescoping section can at least partially accommodate therein said second telescoping section, said hollow cylinder of said first telescoping section having a portion of its outer circumference threaded to receive a cap, said cap having a portion of an interior cylindrical surface thereof threaded to thredingly engage said first telescoping section cylinder, said cap further having an aperture therein to accommodate said second telescoping section, said hollow cylinder of said first telescoping section having a ring-like score provided on its interior cylindrical surface for accommodating therein alignment means, said alignment means facilitating alignment of the major axes of said telescoping sections when said alignment means of said first telescoping section is placed in proximal relationship with companion alignment means provided on the outer cylindrical surface of said second telescoping section; and, handle grip means provided at a distal end of the furtherest extendable of said telescoping sections.

19. The control unit of claim 18, wherein said alignment means comprises an annular piece of nylon.

20. The control unit of claim 18, wherein said handle means further comprises:

electrical switch means mounted on said handle grip means; and, electrical conductor means for electrically connecting said electrical switch means to said drive unit.

21. The control unit of claim 20, wherein a portion of said electrical conductor means comprises a helical coil-like chord which is extendable through said telescoping sections.

22. The outboard marine motor assembly of claim 20, wherein said electrical switch means comprises a first electrical switch for selectively activating and deactivating said driving means and a second electrical switch for selecting the speed of said driving means.

* * * * *